US010337206B2

(12) United States Patent
Huang et al.

(10) Patent No.: US 10,337,206 B2
(45) **Date of Patent: *Jul. 2, 2019**

(54) HIDDEN-LOCK DOOR PANEL AND CONTAINING DEVICE HAVING THE SAME

(71) Applicant: DELTA ELECTRONICS, INC., Taoyuan (TW)

(72) Inventors: Yen-Wen Huang, Taoyuan (TW); Kuan-Lung Wu, Taoyuan (TW); Chia-Hui Chen, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/956,174

(22) Filed: Apr. 18, 2018

(65) Prior Publication Data

US 2018/0238078 A1 Aug. 23, 2018

Related U.S. Application Data

(63) Continuation of application No. 15/059,828, filed on Mar. 3, 2016, now Pat. No. 9,982,456.

(30) Foreign Application Priority Data

Oct. 8, 2015 (TW) ..... 104133207 A

(51) Int. Cl.
*E05B 17/14* (2006.01)
*E05B 13/00* (2006.01)
(Continued)

(52) U.S. Cl.
CPC ..... *E05B 17/147* (2013.01); *E05B 13/001* (2013.01); *E05B 17/186* (2013.01);
(Continued)

(58) Field of Classification Search
CPC ..... E05B 13/00; E05B 13/001; E05B 17/14; E05B 17/145; E05B 17/147; E05B 17/18; E05B 17/186
See application file for complete search history.

(56) References Cited

U.S. PATENT DOCUMENTS 1,061,866 A * 5/1913 Petersen ..... E05B 17/14 70/423
2,458,002 A * 1/1949 Kaskouras ..... E05B 13/001 292/DIG. 2

(Continued)

FOREIGN PATENT DOCUMENTS

CN 202227809 5/2015
CN 204326754 5/2015

OTHER PUBLICATIONS

Office Action dated Jun. 27, 2016 from corresponding application No. TW 104133207.

*Primary Examiner* — Christopher J Boswell
(74) *Attorney, Agent, or Firm* — Hauptman Ham, LLP

(57) ABSTRACT

A hidden-lock door panel for use in a container includes a door panel body, a covering lid, a first lock, and a second lock. The door panel body includes a hidden space. The covering lid is disposed corresponding to the hidden space and slidably connected to the door panel body. The first lock and the second lock are both disposed in the hidden space. The first lock is an electronic lock and is used to control whether the covering lid can be released to slide. The second lock is used to control the door panel body to be unlocked or locked with respect to the container. Accordingly, unknowing persons are prevented from opening or breaking the door lock.

7 Claims, 14 Drawing Sheets

(51) Int. Cl.

| | |
|---|---|
| ***E05B 17/18*** | (2006.01) |
| ***E05B 47/00*** | (2006.01) |
| ***E05B 49/00*** | (2006.01) |
| ***E05B 65/46*** | (2017.01) |
| ***E06B 3/70*** | (2006.01) |
| ***E06B 7/02*** | (2006.01) |
| ***E05B 63/14*** | (2006.01) |
| ***E05B 65/00*** | (2006.01) |
| *E05B 37/20* | (2006.01) |
| *E05C 9/00* | (2006.01) |

(52) U.S. Cl.

CPC ..... *E05B 47/00* (2013.01); *E05B 49/00* (2013.01); *E05B 63/143* (2013.01); *E05B 65/0075* (2013.01); *E05B 65/46* (2013.01); *E06B 3/7001* (2013.01); *E06B 7/02* (2013.01); *E05B 37/20* (2013.01); *E05B 2047/0094* (2013.01); *E05C 9/00* (2013.01); *E06B 2003/7046* (2013.01); *E06B 2003/7094* (2013.01)

(56) References Cited

U.S. PATENT DOCUMENTS

| | | | | |
|---|---|---|---|---|
| 4,918,957 | A * | 4/1990 | Eisermann | E05B 13/00 70/276 |
| 5,203,187 | A * | 4/1993 | Kane | E05B 13/001 292/DIG. 2 |
| 6,324,879 | B1 * | 12/2001 | Kennedy | E05B 13/001 70/416 |
| 6,564,998 | B1 * | 5/2003 | Oross | E05B 17/147 235/380 |
| 6,658,906 | B1 * | 12/2003 | Wright | E05B 13/001 292/292 |
| 7,775,564 | B2 * | 8/2010 | Moore | E05B 13/001 220/730 |
| 8,869,574 | B2 * | 10/2014 | Schmidt-Lackner | E05B 17/147 292/244 |
| 9,587,416 | B1 * | 3/2017 | Liu | E05B 17/185 |
| 9,982,456 | B2 * | 5/2018 | Huang | E05B 17/147 |
| 2003/0070456 | A1 * | 4/2003 | Zamberg | E05B 13/001 70/208 |
| 2008/0190157 | A1 * | 8/2008 | Mizuno | E05B 17/183 70/455 |

* cited by examiner

HIDDEN-LOCK DOOR PANEL AND CONTAINING DEVICE HAVING THE SAME

CROSS-REFERENCE TO RELATED APPLICATIONS

This application is a continuation application of U.S. application Ser. No. 15/059,828 filed on Mar. 3, 2016, which claims priority to TW104133207 filed Oct. 8, 2015. The entire disclosure is incorporated herein by reference.

TECHNICAL FIELD

The present invention relates to a door panel and, in particular, to a hidden-lock door panel and a containing device having the same.

BACKGROUND

In order to prevent other persons from opening a containing device (e.g. a box, a case, or a container) without authorization, conventional ways are to dispose door locks on door panels, so that only persons with a proper opening tool (e.g. a key) can open the door panel, and other persons without the proper opening tool cannot open it, thereby achieving a locking purpose.

However, the conventional door locks are exposed on the door panel, so other persons still have chances to open/break the door lock by using a picking tool/breaking tool, and consequently, the door panel is opened and objects received in the containing device are stolen or damaged. In other words, the conventional locked door panels cannot prevent other persons who have no proper opening tools from opening the door panel.

Accordingly, the aim of the present invention is to improve and solve the above defects.

SUMMARY

It is an object of the present invention to provide a hidden-lock door panel and a containing device having the same. By utilizing a double-hidden design which hiding a first lock and a second lock, the first lock has to be opened first to expose the second lock for unlocking the same, so unknowing persons do not know how and where to open or break the lock.

Accordingly, the present invention provides a hidden-lock door panel for use in a container, the door panel comprising: a door panel body including a hidden space; a covering lid, the covering lid being disposed corresponding to the hidden space and slidably connected to the door panel body; a first lock, the first lock being an electronic lock and disposed in the hidden space, the first lock stopping or releasing a sliding movement of the covering lid; and a second lock disposed in the hidden space for unlocking or locking the door panel body with respect to the container.

The present invention further provides a containing device with a hidden-lock door panel, comprising: a container including an opening; and a door panel, the door panel correspondingly covering the opening to open or close the same. The door panel comprises: a door panel body including a hidden space; a covering lid, the covering lid being slidably connected to the door panel body and disposed corresponding to the hidden space; a first lock, the first lock being an electronic lock and disposed in the hidden space, the first lock stopping or releasing a sliding movement of the covering lid; and a second lock disposed in the hidden space to unlock or lock the door panel body with respect to the container.

Compared to conventional techniques, the present invention has the following feature. By utilizing a double-hidden design which hiding the first and second locks, the first lock has to be opened first to expose the second lock, so unknowing persons do not know how or where to open or break the lock.

BRIEF DESCRIPTION OF THE DRAWINGS

The disclosure will become more fully understood from the detailed description and the drawings given herein below for illustration only, and thus does not limit the disclosure, wherein.

DETAILED DESCRIPTION

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

The present invention provides a hidden-lock door panel and a containing device having the same. According to this invention, persons cannot find a door lock to open the door panel, or to use a picking/breaking tool to open/break the door lock, and therefore the door panel is locked against all persons except those in possession of an opening tool (ex. a proper key or an access card) to the door panel.

Figure 1:
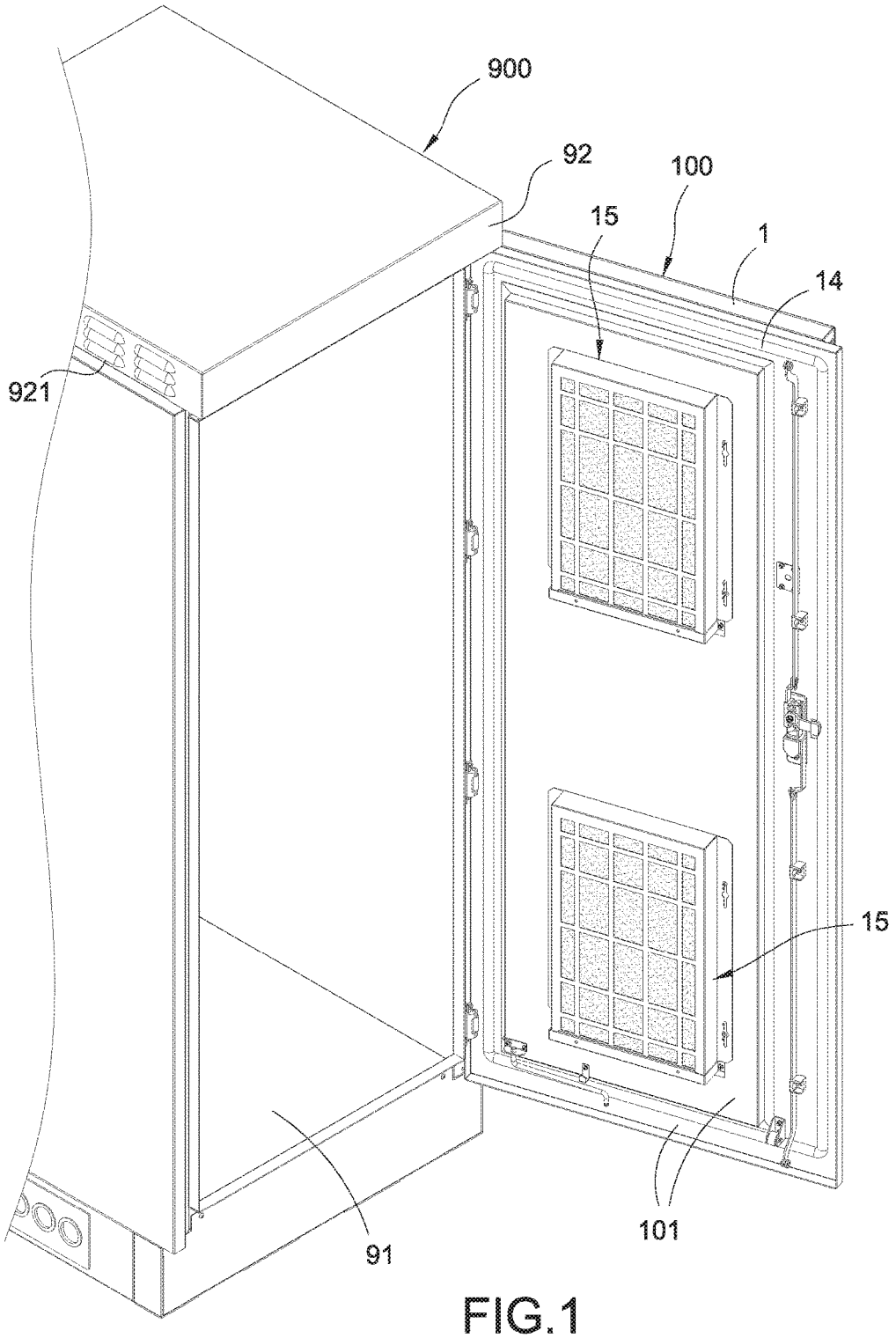
FIG. 1 is a perspective view of the present invention, showing a containing device with its door panel left open.
Figure 2:
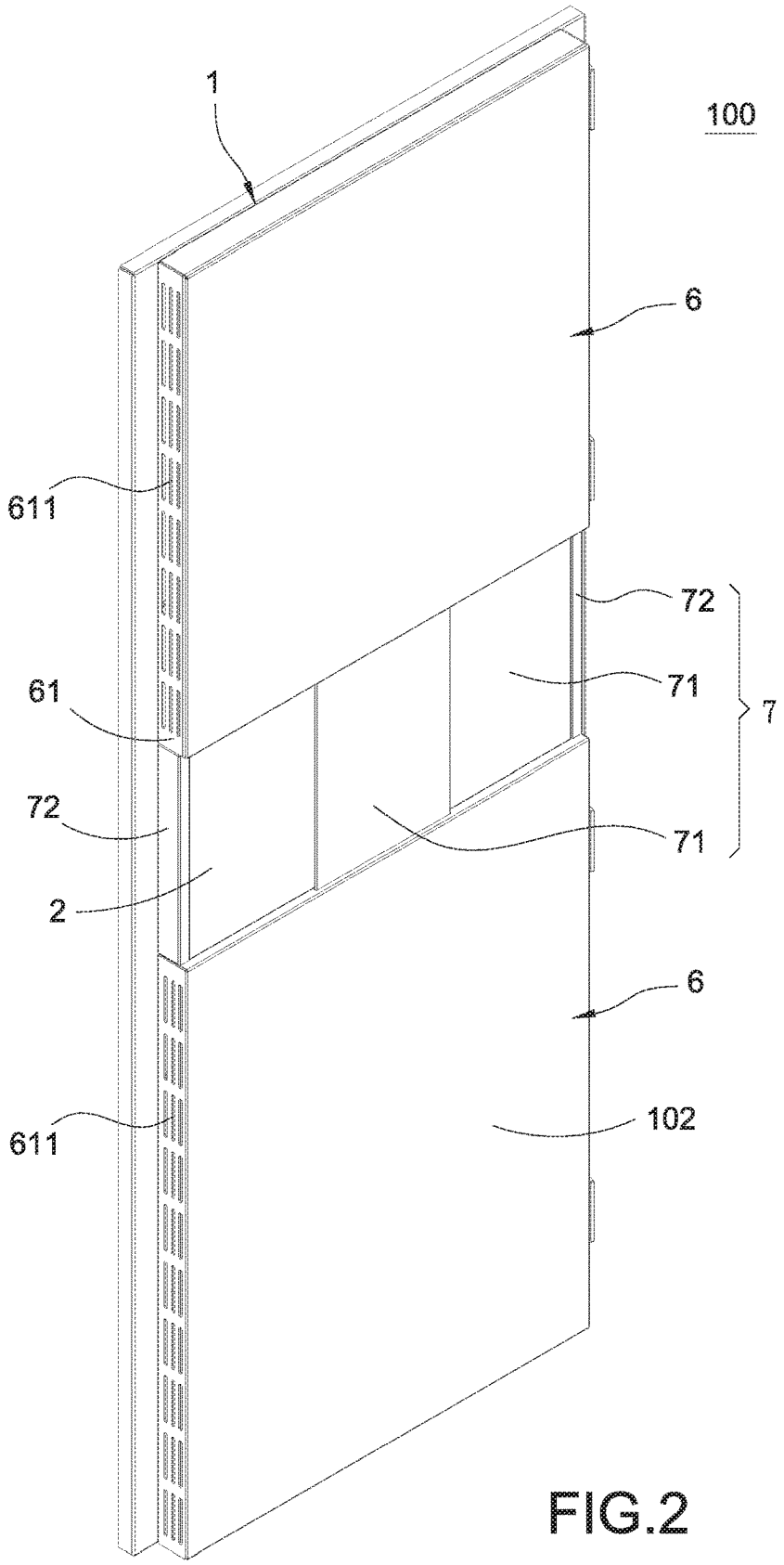
FIG. 2 is a perspective view showing the door panel according to a first embodiment of the present invention.

The containing device of the present invention is, for example, a jewelry box, a safe deposit box, a safe deposit cabinet, a machine cabinet; the present invention is not limited in this regard. As shown in FIG. 1, the containing device includes a container 900 and a door panel 100 covering the container 900 in a closable and openable manner.

Referring to FIGS. 1 to 5, according to a first embodiment of the present invention, a door panel 100 comprises a door panel body 1, a covering lid 2, a first lock 3, and a second lock 4.

Figure 3:
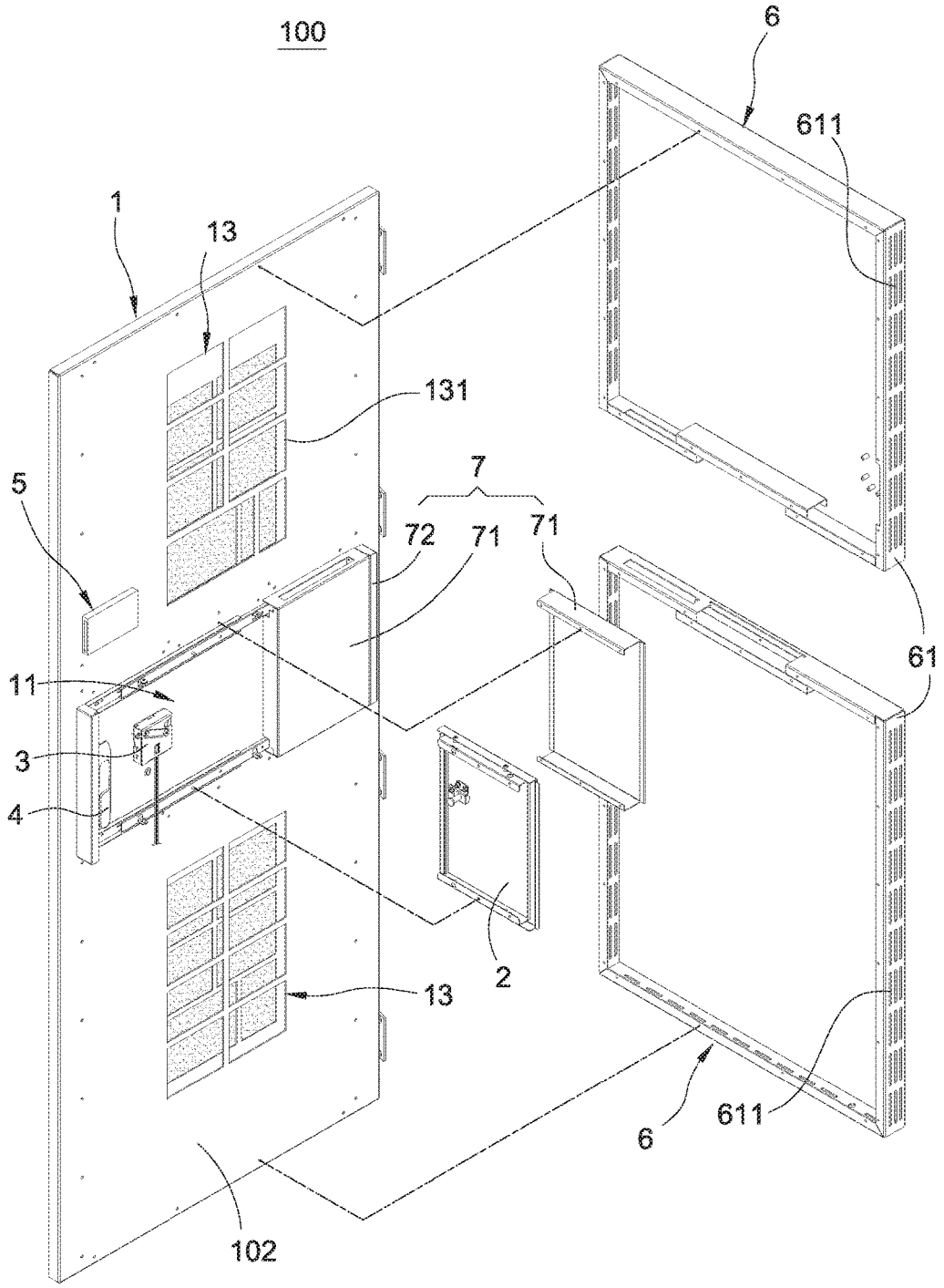
FIG. 3 is a perspective exploded view of the door panel according to the first embodiment of the present invention.
Figure 4:
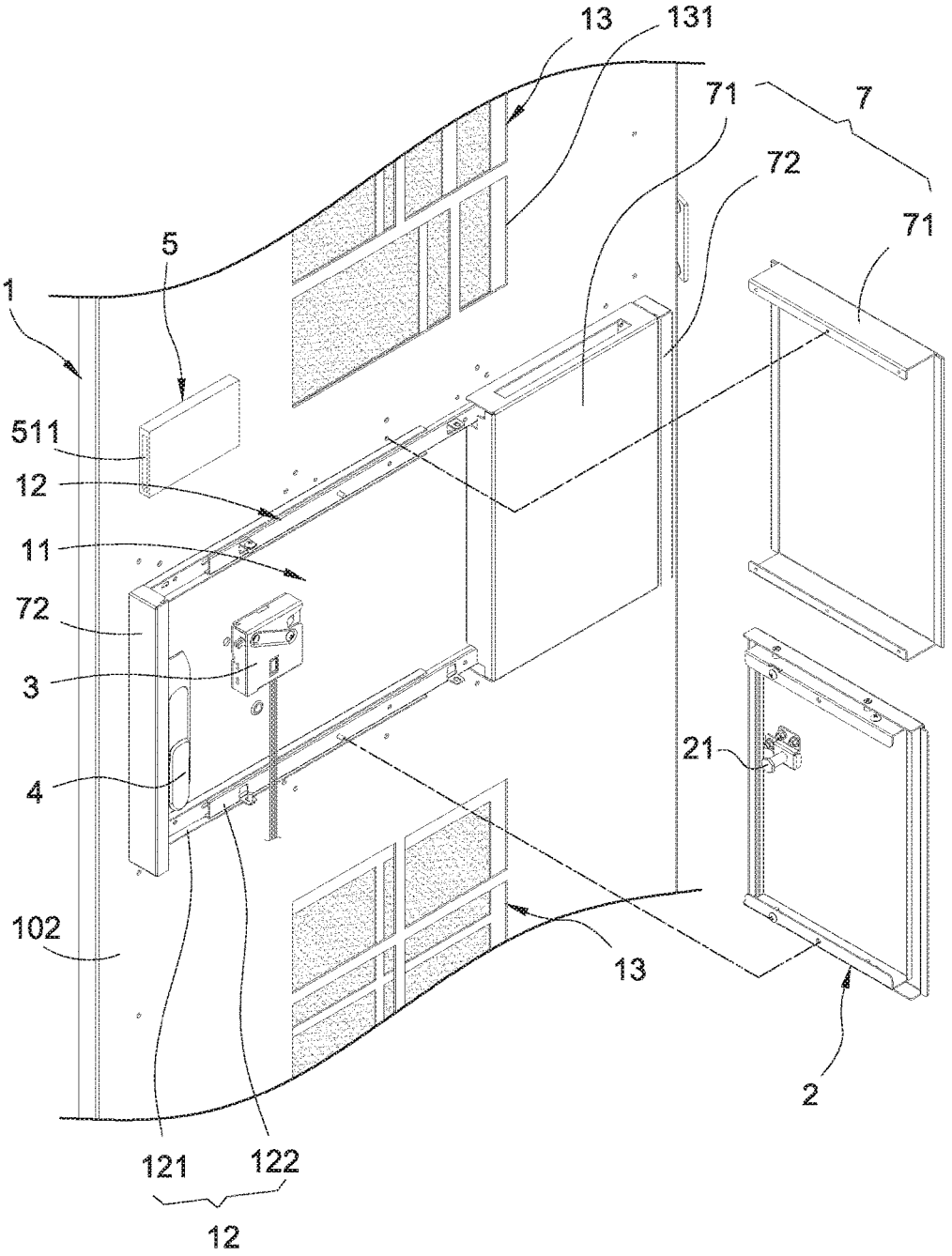
FIG. 4 is a partially enlarged view of FIG. 3 of the present invention.
Figure 5:
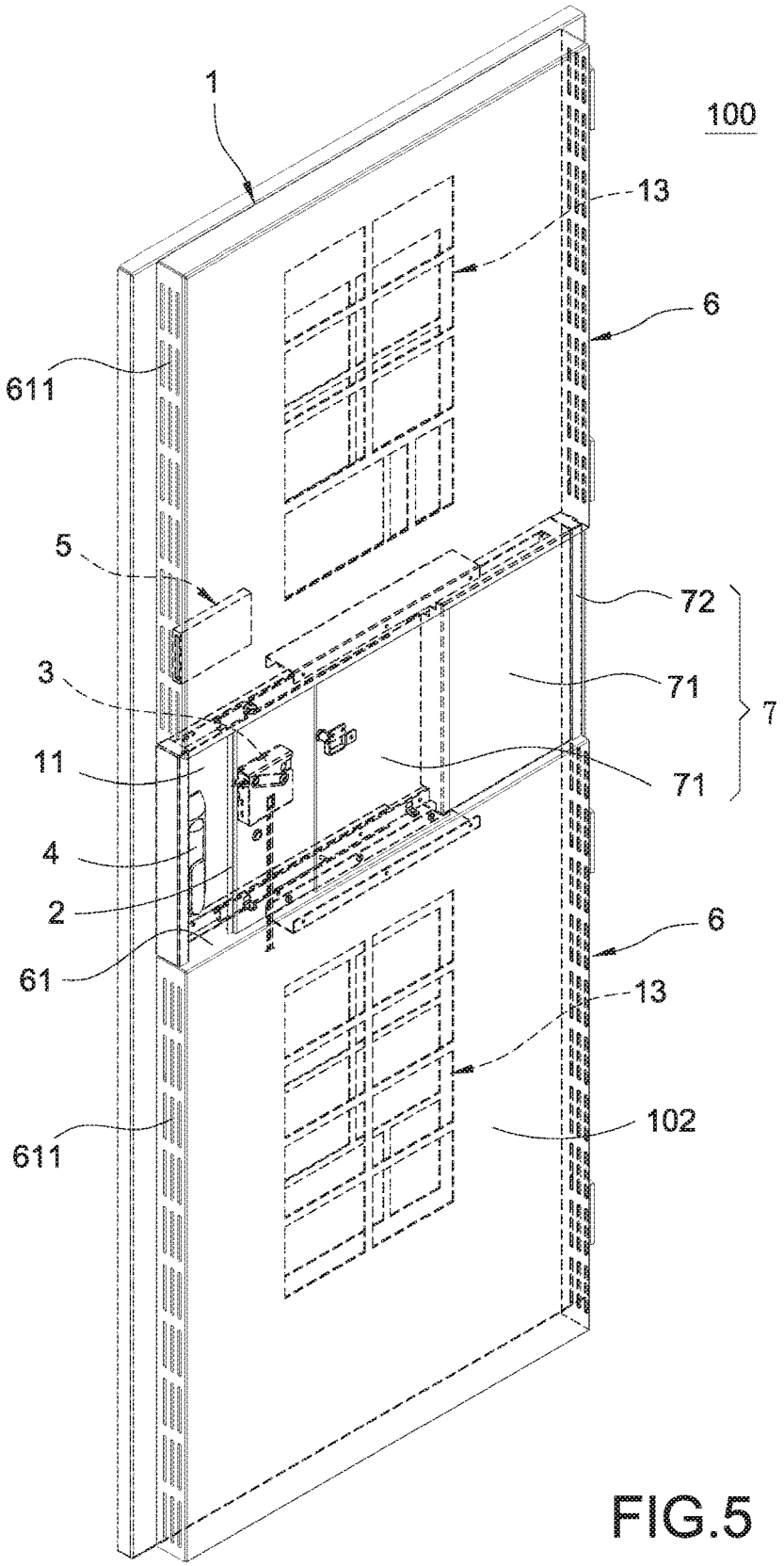
FIG. 5 is a perspective assembled view of the door panel according to the first embodiment of the present invention.

The door panel body 1 includes a hidden space 11 and includes an inner side 101 and an outer side 102 opposite to each other. The hidden space 11 can be produced directly in the door panel body 1 or can be produced with other structure. As shown in FIGS. 3 to 5, in the present embodiment, two covers 6 and two disguise frames 72 are used to enclose and form the desired hidden space 11 on the door panel (detailed hereinafter).

The covering lid 2 is disposed corresponding to the hidden space 11 and is slidably connected to the door panel body 1, so that the hidden space 11 is covered by the covering lid 2. A variety of structures can be used to make the covering lid 2 slidable; in this embodiment, a slide rail is used as an example. For example, the outer side 102 of the door panel body 1 is disposed with two slide rails 12 spaced apart from and corresponding to each other. Each of the slide rails 12 includes a fixed element 121 and a slide element 122 slidably connected to each other. The fixed element 121 of each of the slide rails 12 is fixed to the outer side 102 of the door panel body 1, and the slide element 122 of each of the slide rails 12 is fixed to the covering lid 2, so that the cover lid 2 is slidable by means of the two slide rails 12 to open or close the hidden space 11.

The first lock 3 is an electronic lock. The electronic lock is, for example, a remote control lock or an access control lock which can be unlocked or locked electrically. In the present embodiment, the first lock 3 is an access control lock as an example for explanation. Therefore, a card reader 5 is disposed, and the first lock 3 and the card reader 5 are electrically connected to each other to use the card reader 5 to control the first lock 3 to be unlocked or locked. The first lock 3 is disposed in the hidden space 11 to be covered by the covering lid 2. The first lock 3 also acts on the covering lid 2 to restrict or release a sliding movement of the covering lid 2. For instance, when the first lock 3 is locked, the covering lid 2 is stopped from sliding. When the first lock 3 is unlocked, the covering lid 2 is released to be slidable. The card reader 5 is disposed and hidden in the door panel body 1, so as to prevent a person having an improperly obtained access card from using it (detailed hereinafter).

The second lock 4 can be a variety of mechanical locks, such as a manually operable lock or a key-operable lock, and the present invention is not limited in this regard. In the present embodiment, to give an example for explanation, the second lock 4 is a manually operable lock as illustrated in the drawing. The second lock 4 is also disposed in the hidden space 11 to be covered by the covering lid 2. Therefore, a user has to open the first lock 3 first, then the covering lid 2 can be pushed to expose the second lock 4, and after that, a user can proceed to open the second lock 4.

As shown in FIGS. 1 and 5, the second lock 4 is used to unlock or lock the door panel body 1 with respect to the container 900. Therefore, when the user opens the second lock 4, the door panel 100 can be opened. However, the first lock 3 has to be opened first before opening the second lock 4, thus achieving the purpose of hiding the door lock and keeping other persons from finding the door lock to open the door panel or to use a picking/breaking tool to the door lock.

Figure 6:
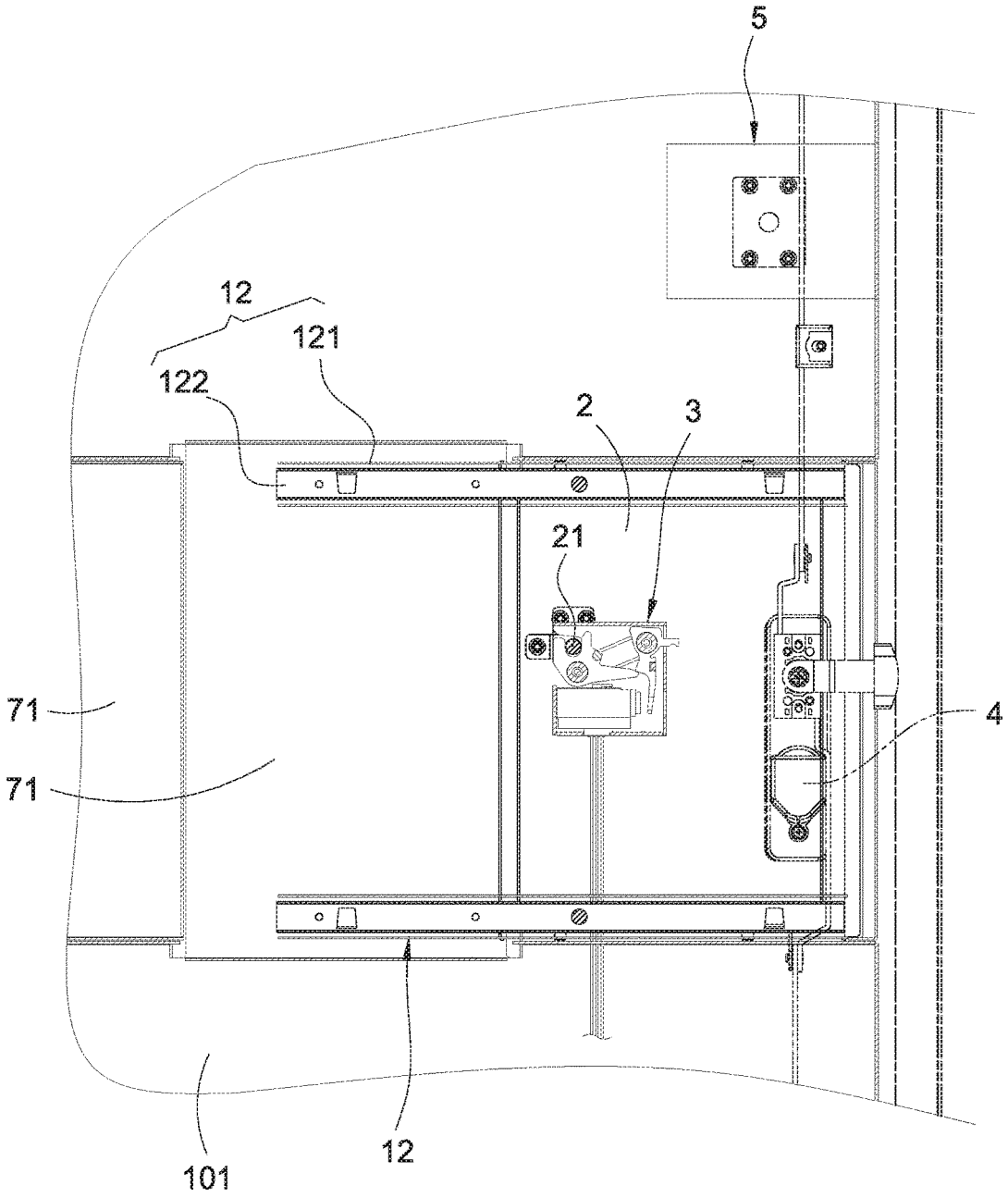
FIG. 6 is a partial view showing the door panel before a covering lid is opened, according to the first embodiment of the present invention.
Figure 7:
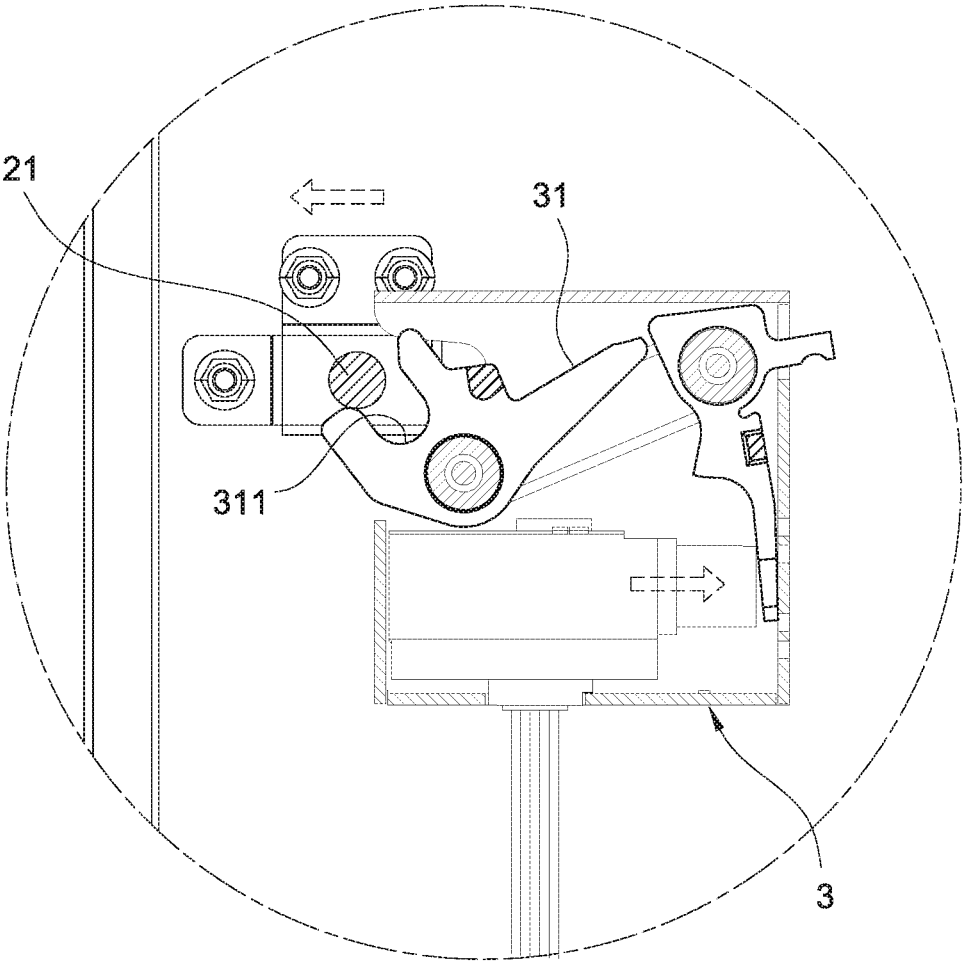
FIG. 7 is a partially enlarged view of a first lock shown in FIG. 6 according to the present invention.
Figure 8:
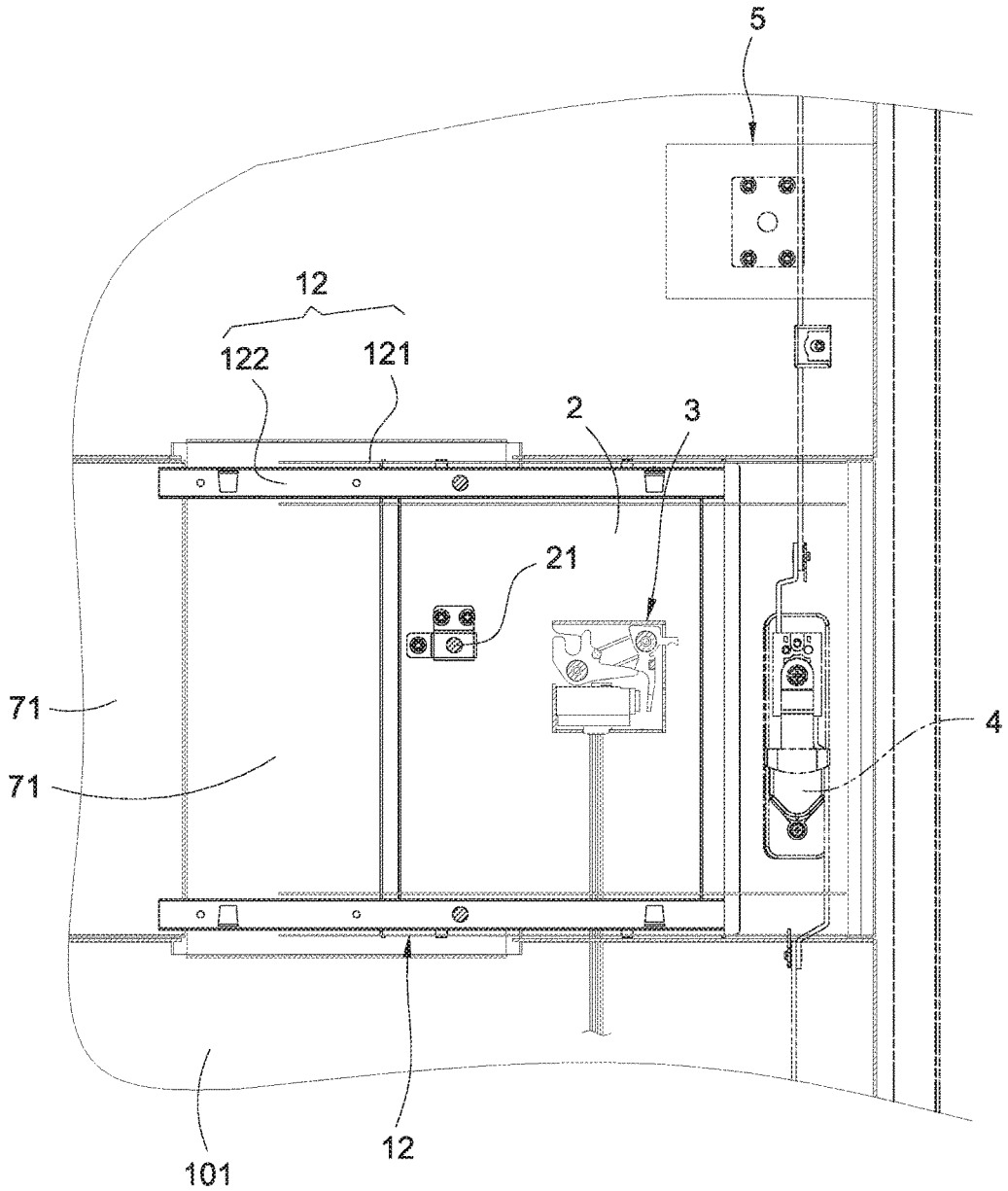
FIG. 8 is a partial view showing the door panel after the covering lid is opened, according to the first embodiment of the preset invention.
Figure 9:
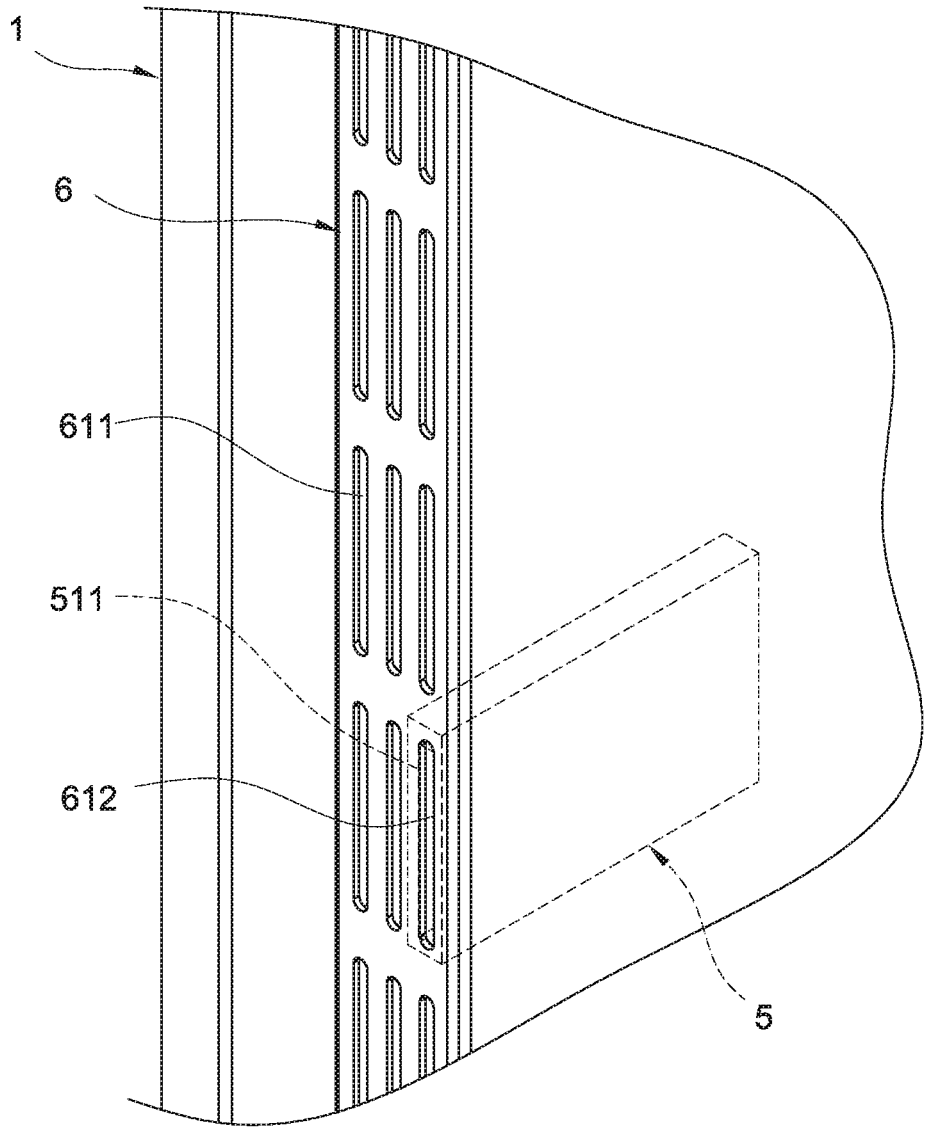
FIG. 9 is a partially enlarged view showing a card reader according to the first embodiment of the present invention.

As shown in FIG. 7, the first lock 3 includes a lock element 31 which can be controlled to unlock or lock. The covering lid 2 includes a fastening element 21 (see FIG. 4) corresponding to the lock element 31. When the first lock 3 is in a locked state as shown in FIG. 6, the fastening element 21 is restricted in a jaw portion 311 of the lock element 31, and thus the covering lid 2 is not slidable. When the first lock 3 is in an opened state as shown in FIG. 7, i.e. the lock element 31 is controlled to rotate to release the fastening element 21, the covering lid 2 can be laterally pushed to slide by the user's exerting a force, so as to expose the second lock 4 hidden in the hidden space 11 as shown in FIGS. 5 and 8.

Referring to FIGS. 1 to 5, the door panel 100 of the present invention further includes a plurality of covers 6 and a disguise structure 7. The disguise structure 7 includes a plurality of disguise lids 71 and a plurality of disguise frames 72. The door panel body 1 includes a plurality of ventilation portions 13. For the purpose of describing the present embodiment, two covers 6, two disguise lids 71, two disguise frames 72, and two ventilation portions 13 are used herein as an example. A lateral side portion 61 of the cover 6 includes a plurality of air vents 611, the ventilation portion 13 includes a plurality of ventilation openings 131, and the two ventilation portions 13 are arranged spaced apart from each other. Each of the covers 6 covers a respective corresponding one of the ventilation portions 13 and is fixed to the door panel body 1. The two disguise frames 72 are connected between two adjacent end portions of the lateral side portions 61 of the two covers 6 and are fixed to the door panel body 1. The two covers 6 and the two disguise frames 72 surround to form the hidden space 11 among the two covers 6, two disguise frames 72 and the outer side 102 of the door panel body 1.

The covering lid 2 and the two disguise lids 71 are arranged in a row to correspondingly cover the hidden space 11 in such a manner to form a level difference (see FIG. 2) between the two adjacent disguise lids 71 and between the covering lid 2 and the disguise lid 71 adjacent to the covering lid 2. By doing so, other unknowing persons would consider that the level difference is just an exterior design, and is not aware that the level difference is to allow a lateral sliding movement of the covering lid 2. If there is no level difference, the covering lid 2 will be stopped, by the disguise lid 71, from sliding laterally. The two disguise lids 71 are fixed to the door panel body 1.

Referring to FIGS. 3 to 5 and FIG. 9, there are various ways to make the card reader 5 disposed and hidden in the door panel body 1. In the present embodiment, any of the covers 6 can be used to cover and hide the card reader 5 (see FIG. 5). The card reader 5 defines a slot 511 for insertion of an access card. One of the air vents of the cover 6 is disposed corresponding to the slot 511 to be a disguise air vent 612. The access card can reach a suitable position to be read by the card reader 5 via the disguise air vent 612 and the slot 511. However, for other unknowing persons, even if they know that the access card is required to open the door lock, they do not know the exact position of the card reader 5 at all. Even if they know the exact position of the card reader 5, the door panel body 1 is made of metal, so it is not possible to read the access card outside the door panel body 1 and to get to know that one of the many air vents 611 is actually an insertion slot (i.e. the disguise air vent 612) for insertion of the access card, thereby providing multiple protection. Besides, in some embodiment not illustrated, the card reader 5 can be mounted in the door panel body 1 and expose its surface, in a disguised manner, for reading the access card.

Figure 10:
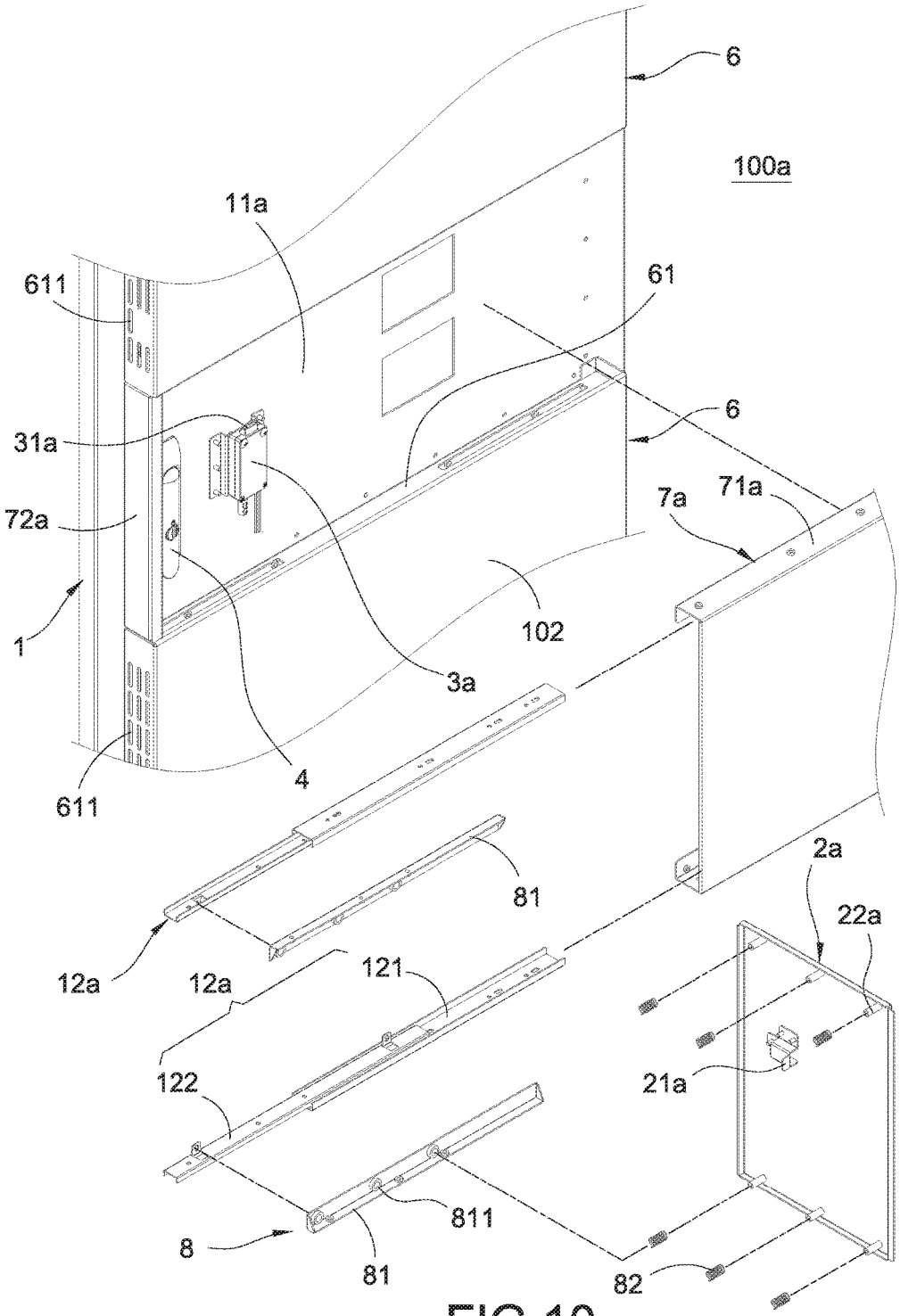
FIG. 10 is a perspective exploded view of a door panel according to a second embodiment of the present invention.
Figure 11:
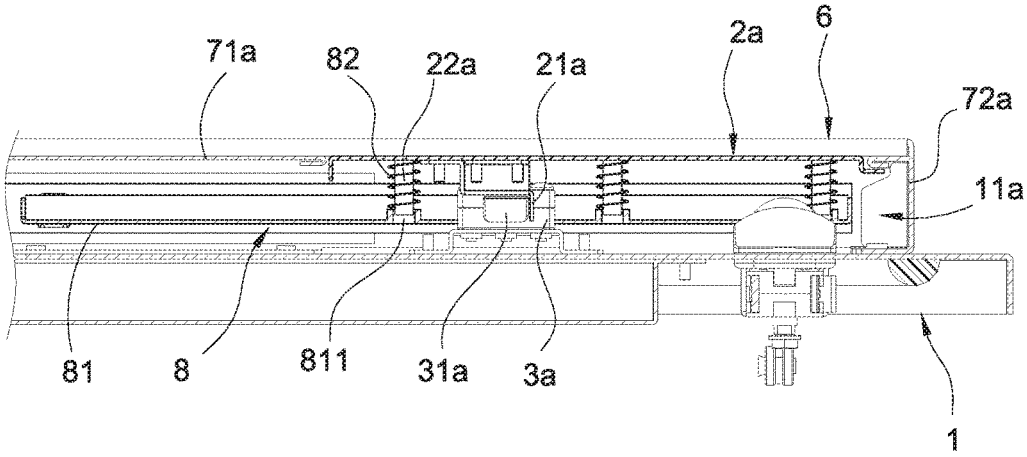
FIG. 11 is a cross-sectional view of the door panel after assembled according to the second embodiment of the present invention.

FIGS. 10 and 11 illustrate the door panel 100*a* according to a second embodiment of the present invention. The second embodiment is similar to the first embodiment with the difference that the covering lid 2*a* is flexibly pressed inwardly using a flexible support structure 8. The flexible support structure 8 and its related configuration are detailed as follows.

The disguise structure 7*a* includes a disguise lid 71*a* and at least one disguise frame 72*a*. The at least one disguise frame 72*a* is connected between adjacent lateral side portions 61 of the two covers 6 and is fixed to the door panel body 1. Two covers 6 and at least one disguise frame 72*a* surround to form the hidden space 11*a*. The covering lid 2*a* and the disguise lid 71*a* are arranged in a row to correspondingly cover the hidden space 11*a* in a manner such that the covering lid 2*a* and the disguise lid 71*a* are flush with each other (see FIG. 11).

A fixed element 121 of each slide rail 12*a* is fixed to the disguise lid 71*a*. The slide element 122 of each slide rail 12*a* is fixed to the covering lid 2*a*.

The first lock 3*a* is disposed with a lock element 31*a*. The covering lid 2*a* includes a fastening element 21*a* disposed corresponding to the lock element 31*a*, so that the first lock 3*a* can be controlled to stop or release the covering lid 2*a*.

The flexible support structure 8 is disposed between and flexibly supports the covering lid 2*a* and the slide element 122 of each of the slide rails 12*a*, so that the covering lid 2*a* can be flexibly pressed inwardly toward the door panel body 1 by exerting an external force, so as to form the level difference to facilitate the lateral sliding movement of the covering lid 2*a*; certainly, the covering lid 2*a* can also be restored resiliently by a resilient force of the flexible support structure 8 in a direction opposite to the door panel body 1.

To be specific, the flexible support structure 8 includes a plurality of frame elements 81 and a plurality of flexible elements 82. Each of the frame elements 81 is fixed to the slide element 122 of each of the slide rails 12*a*. The frame element 81 and the covering lid 2*a* are disposed with a plurality of insertion elements 22*a* (guide pillars) and a plurality of retaining elements 811 (hollow pillars) for insertion of the respectively corresponding insertion elements 22*a*; however, it is not limited by this invention which one (the frame element 81 or the covering lid 2*a*) is disposed with the insertion elements 22*a* and which one (the frame element 81 or the covering lid 2*a*) is disposed with the retaining elements 811. In regard to the insertion element 22*a* and the retaining element 811, the insertion element 22*a* can be the guide pillar (or the hollow pillar), and the retaining element 811 can be the hollow pillar (or the guide pillar). Each of the flexible elements 82 receives each of the insertion elements 22*a*, so that each of the flexible elements 82 is flexibly disposed between a respectively corresponding one of the retaining elements 811 and the covering lid 2*a*; meanwhile, an extendible lock element 31*a* extends out and restricts the fastening element 21*a* of the covering lid 2*a* to thereby prevent the covering lid 2*a* from sliding (see FIG. 11).

Figure 12:
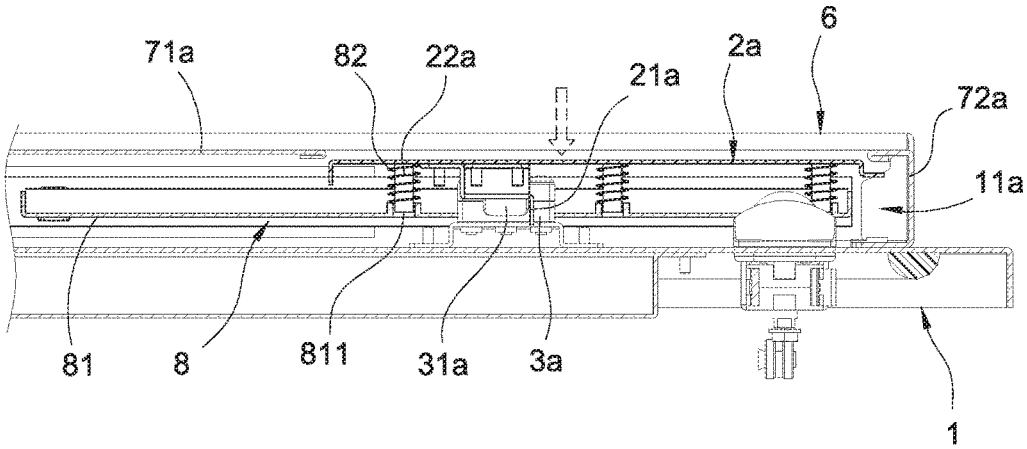
FIG. 12 is a cross-sectional view showing the door panel of FIG. 11 after pushing the covering lid according to the present invention.
Figure 13:
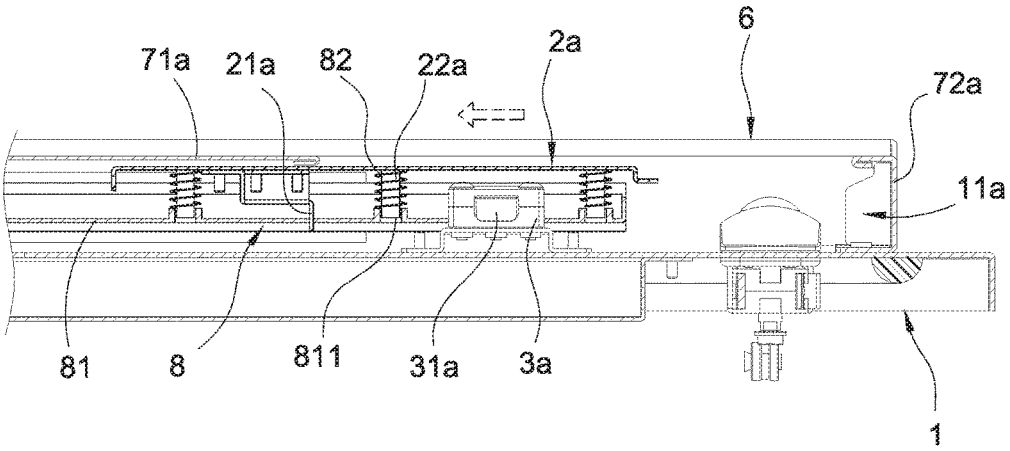
FIG. 13 is a cross-sectional view showing the door panel of FIG. 12 after sliding the covering lid according to the present invention.
Figure 14:
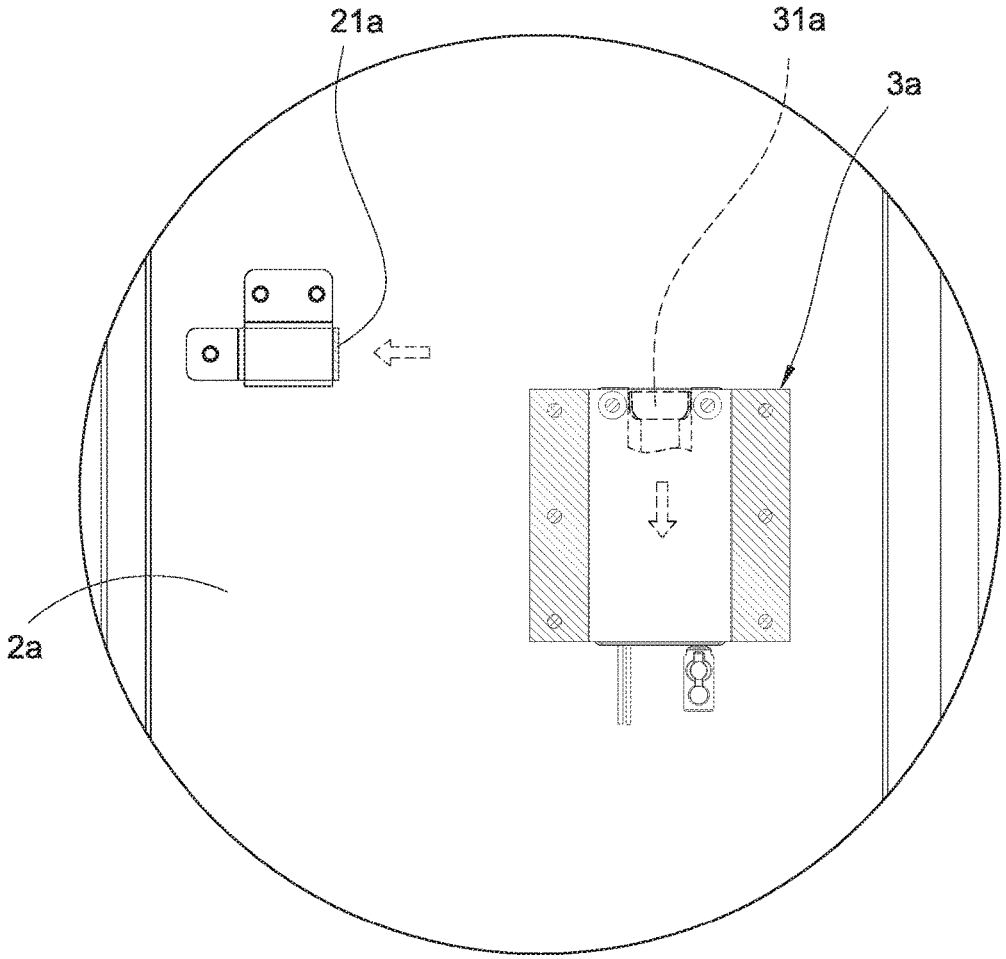
FIG. 14 is a schematic view showing the door panel after the first lock is released according to the second embodiment of the present invention.

As shown in FIGS. 12 and 13, when the user opens the first lock 3*a*, the lock element 31*a* retracts inwardly, as illustrated in FIG. 14, to release the fastening element 21*a*. After that, by the user's pushing toward the outer side 102 of the door panel body 1, the insertion elements 22*a* are respectively inserted into the retaining elements 811 correspondingly; at the same time, the flexible elements 82 are resiliently depressed to accumulate a restoring force and generate the level difference between the covering lid 2*a* and the disguise lid 71*a*. Finally, the user only needs to laterally push the covering lid 2*a*, the covering lid 2*a* can be laterally pushed away to expose the second lock 4 which is originally covered and hidden.

The door panel 100 in the first embodiment and the door panel 100*a* in the second embodiment of the present invention also provide ventilation, and the ventilation is achieved mainly by means of the air vents 611 of the cover 6 communicating with the ventilation portions 13 of the door panel body 1, so as to continuously draw the outside air into the container 900.

Figure 15:
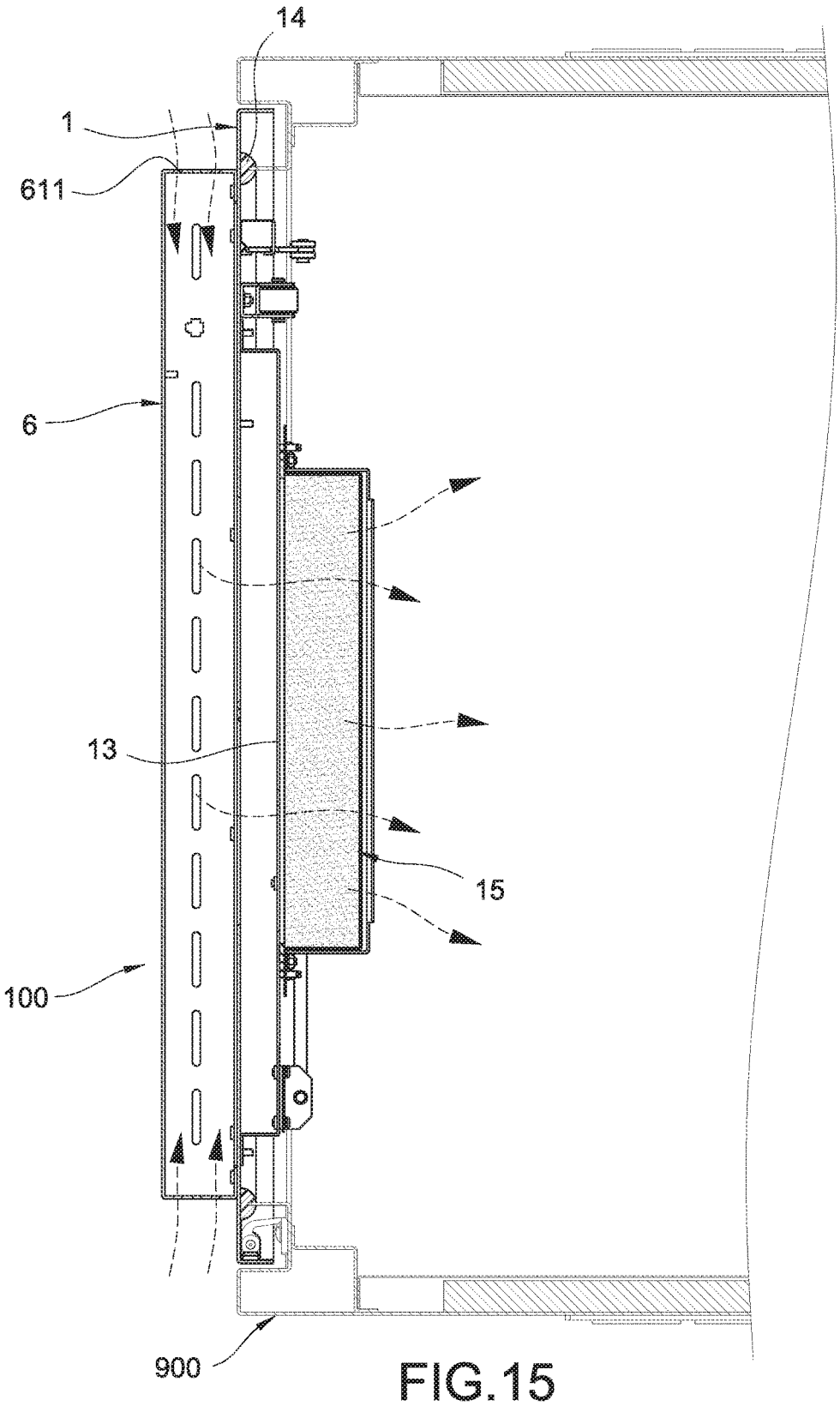
FIG. 15 is a schematic view showing the flow of air in the containing device of the present invention.

As shown in FIGS. 1, 5 and 15, the containing device of the present invention includes a container 900 and a door panel 100 (100*a*) covering the container 900 to open or close the same. The container 900 includes an opening 91 and is disposed with a vent exhaust assembly 92. The vent exhaust assembly 92 is disposed with at least one blower (not illustrated) and includes a plurality of exhaust ports 921, and the door panel 100 covers the opening 91 of the container 900 to open or close the same.

On the inner side 101 of the door panel body 1 abutting the container 900, a water-proof and air-proof sealing strip 14 is surroundingly disposed, and the water-proof and air-proof sealing strip 14 surroundingly disposed on the door panel body 1 is disposed corresponding to the periphery of the opening 91, so as to provide a water-proof and dust-proof effect after the door panel 100 is closed to cover the container 900.

When the vent exhaust assembly 92 is turned on, the outside air is drawn into the container 900 by means of the blower inside the vent exhaust assembly 92 via the air vents 611 and the ventilation portions 13, and then is discharged via the exhaust ports 921 of the vent exhaust assembly 92 to establish a ventilation exhaust path for providing continuous air circulation, which is suitable for a machine cabinet with a closed space in need of heat dissipation.

It is preferable that a plurality of filtering net structures 15 are disposed at the inner side 101 of the door panel body 1 and are respectively disposed corresponding to the ventilation portions 13 for filtering the outside air.

In summary, compared with conventional techniques, the present invention has the following feature. By using a double-hidden-lock design which hiding the first and second locks 3, 4 (3*a*, 4*a*), the first lock 3 (3*a*) has to be opened first, and then the second lock 4 (4*a*) can be revealed and unlocked by the user, thereby making unknowing persons unable to open or break the door locks.

Furthermore, the present invention also provides other features. By hiding the card reader 5 and hiding the position (the disguise air vent 612) for reading the access card, a person having an improperly obtained access card is prevented from using it. In addition, this person also has to push away the covering lid 2 (2*a*) on his own. Therefore, even in the unlikely event that some unknowing person manages to open the first lock 3 (3*a*), he still could not open the door panel 100 (100*a*) without knowing the tip of pushing away the covering lid 2 (2*a*). The second embodiment of the present invention even provides an additional limitation that the covering lid 2 (2*a*) has to be pushed first to be pushed away laterally, thereby achieving multiple protection. By using the water-proof and air-proof sealing strip 14, the present invention provides the water-proof and dust-proof effect. The door panel 100 (100*a*) has ventilation with the outside air, the container 900 is also disposed with the vent exhaust assembly 92 to draw the outside air into the container 900 and discharge the air via the exhaust port 921 of the vent exhaust assembly 92 to establish the ventilation exhaust path for achieving continuous air flow circulation, which is suitable for a machine cabinet with a closed space in need of heat dissipation. Furthermore, the outside air is filtered by the filtering net structure 15 added to the door panel body 1.

It is to be understood that the above descriptions are merely the preferable embodiments of the present invention and are not intended to limit the scope of the present invention. Equivalent changes and modifications made in the spirit of the present invention are regarded as falling within the scope of the present invention.

What is claimed is:

1. A hidden-lock door panel for use in a container, the door panel comprising:

a door panel body including a hidden space;

a covering lid, the covering lid being disposed corresponding to the hidden space and slidably connected to the door panel body;

a first lock, the first lock being an electronic lock and disposed in the hidden space and covered by the covering lid, the first lock stopping or releasing a sliding movement of the covering lid; and a second lock disposed in the hidden space and covered by the covering lid for unlocking or locking the door panel body with respect to the container, wherein when the first lock is opened, the covering lid can be laterally pushed to slide, and the second lock hidden in the hidden space is thereby exposed.

2. The hidden-lock door panel of claim 1, wherein the covering lid covers the first lock and the second lock corresponding to the hidden space.

3. The hidden-lock door panel of claim 1, wherein the door panel body further includes two slide rails, each of the slide rails includes a fixed element and a slide element slidably connected to each other, the fixed element of each of the slide rails is fixed to the door panel body, and the slide element of each of the slide rails is fixed to the covering lid.

4. The hidden-lock door panel of claim 1, wherein the second lock is a door lock.

5. The hidden-lock door panel of claim 1, further comprising a card reader, the card reader being disposed and hidden in the door panel body, the first lock being an access control lock electrically connected to the card reader.

6. The hidden-lock door panel of claim 1, wherein the first lock includes a lock element, the covering lid includes a fastening element disposed corresponding to the lock element, and the lock element stops or releases the fastening element.

7. A containing device with a hidden-lock door panel, comprising:

a container including an opening; and a door panel, the door panel correspondingly covering the opening to open or close the same, the door panel comprising:

a door panel body including a hidden space;

a covering lid, the covering lid being slidably connected to the door panel body and disposed corresponding to the hidden space;

a first lock, the first lock being an electronic lock and disposed in the hidden space and covered by the covering lid, the first lock stopping or releasing a sliding movement of the covering lid; and a second lock disposed in the hidden space and covered by the covering lid for unlocking or locking the door panel body with respect to the container, wherein when the first lock is opened, the covering lid can be laterally pushed to slide, and the second lock hidden in the hidden space is thereby exposed.

* * * * *